US005381839A

United States Patent [19]

Dowd

[11] Patent Number: 5,381,839

[45] Date of Patent: Jan. 17, 1995

[54] LIQUID DISBURSER DEVICE

[76] Inventor: Tracy J. Dowd, 64 North St., Georgetown, Mass. 01833

[21] Appl. No.: 918,547

[22] Filed: Jul. 22, 1992

[51] Int. Cl.[6] ..... B65B 39/00

[52] U.S. Cl. ..... 141/242; 141/237; 141/331; 141/334; 141/340; 141/98; 141/297; 141/88; 141/375; 141/376; 220/573; 184/106

[58] Field of Search ..... 141/86-99, 141/98, 234, 236-238, 242-245, 311, 331, 333, 334, 340-342, 363-366, 369, 370, 375, 376, 379, 297-299; 220/573; 184/1.5, 106

[56] References Cited

U.S. PATENT DOCUMENTS

| | | | |
|---|---|---|---|
| 486,762 | 11/1892 | Camden | 141/341 |
| 553,734 | 1/1896 | Iredale | 141/242 |
| 760,069 | 5/1904 | Hunter | 141/297 |
| 858,051 | 6/1907 | Allen | 141/242 |
| 4,114,660 | 9/1978 | Arruda | 141/98 |
| 4,600,125 | 7/1986 | Maynard, Jr. | 141/331 X |
| 4,756,349 | 7/1988 | Atkins | 184/1.5 X |
| 4,823,848 | 4/1989 | Sentmore, Sr. et al. | 141/334 |
| 4,880,156 | 11/1989 | Wallet | 184/1.5 X |

FOREIGN PATENT DOCUMENTS

| | | | |
|---|---|---|---|
| 1442876 | 5/1966 | France | 141/297 |
| 0319319 | 4/1919 | Germany | 141/340 |
| 0154478 | 7/1932 | Switzerland | 141/331 |

*Primary Examiner*—J. Casimer Jacyna
*Attorney, Agent, or Firm*—Edward A. Gordon

[57] ABSTRACT

A liquid disburser device for simultaneously equally filling a plurality of liquid containers from a source of liquid including a top member having an upper funnel chamber section for receiving liquid and a lower liquid discharge column leading downwardly from the upper funnel chamber section; the lower discharge column including an inner diameter of sufficiently reduced size whereby liquid enters the discharge column from the upper funnel chamber in a filling equal amount; the discharge column having a plurality of equally angularly spaced tubular members spaced in equal distance about the bottom portion of the discharge column; the tubular members extending downwardly and having respective end portions adapted to be inserted into the inlet of a liquid container for conducting equal amounts of liquid from the funnel chamber into respective containers to be filled therefrom. In other embodiments, there are provided, for example, devices for controlling the liquid flow; releasable tubular members; support devices; screens and caps.

10 Claims, 5 Drawing Sheets

LIQUID DISBURSER DEVICE

BACKGROUND OF THE INVENTION

1. Field of the Invention

The present invention relates generally to a liquid container filling device and more particularly to a gravity feeding device for simultaneously equally filling a plurality of liquid containers.

2. Description of the Prior Art

There are numerous prior art devices for filling a plurality of containers for various reasons with various fluids from a common source. Many of these devices include a pressurized source of fluid wherein the fluid is fed to a manifold system connected to a plurality of feeder pipes of equal diameter with one feeder pipe for each container to be filled. In these devices, the pressure in each feeder pipe is equal so that the fluid delivered by each feeder pipe is equal. These devices, however, are not applicable to gravity feed systems because in a gravity feed system the pressure is not always equal and the feeder pipe closest to the source of fluid will receive more fluid than those further from the source resulting in the containers being filled at different filling rates and therefore unequally. In some of the prior art gravity feed systems, a separate valve is provided for each feeder pipe filling a container such that as each individual container becomes full, the valve shuts. In many gravity feed devices where the equal filling of the containers is not important, no provision is made to ensure that all containers are filled equally.

U.S. Pat. No. 4,823,848 relates to a multipurpose funnel designed to be threadably attached to the top of a container to facilitate the filling of the container with a chosen material. Interchangeable internally threaded caps may be used in combination with the funnel to permit its attachment to various sized containers having conventional closure-engaging external threads. When not threadably attached to a container, interchangeable neck portions are threadably attached to the funnel. At least one neck section is of a bifurcated design to facilitate the filling of two containers at the same time.

U.S. Pat. No. 4,411,295 relates to a device for equally filling a plurality of containers including a primary distributor disc having a top inlet and a plurality of bottom outlets equally spaced from the top inlet and equally spaced around the primary distributor disc, a plurality of secondary distributor discs, each having a top inlet and a plurality of bottom outlets equally spaced from the secondary distributor disc top inlets and equally around the secondary distributor discs, a plurality of equal fluid conducting pipes, one for connecting each of the outlets of the primary distributor discs to the inlet of one of the secondary distributor discs, and a filler hose connected to each of the outlets of the secondary distributor discs and extending downwardly to one of the containers of the plurality of containers. An electrically controlled valve actuatable by a weight controlled device which generates an electric signal when a selected one of the containers is full may be used to block the flow of fluid to the plurality of containers when the containers reach the desired fullness.

Other prior art devices that are of general interest to show the state-of-the-art are disclosed in U.S. Pat. Nos. 942,271; 1,416,126; 1,790,626; 1,987,580; 2,055,704; 2,447,281; 2,719,496; 2,791,353; 2,872,953; 3,196,909; 3,693,673; 3,794,088; and 3,893,494.

These prior art devices are not exhaustive but are exemplary of the state of the art which relates to container filling devices and/or devices for equally filling a plurality of containers.

While these prior art patents provide improvements in the areas intended, there still exists a great need for a gravity filling for simultaneously equally filling a plurality of liquid containers and which is relatively simple in construction.

Accordingly, a principle desirable object of the present invention is to provide a new and improved liquid disbursing device which provides for equally filling a plurality of containers and which overcomes the disadvantages of prior art device structures.

Another desirable object of the present invention is to provide a liquid disbursing device for equally filling by gravity a plurality of containers.

Another desirable object of the present invention is to provide a liquid disbursing device which aids in recycling liquids.

Another desirable object of the present invention is to provide a liquid disbursing device including a liquid receiver section and a distribution section for equally distributing the liquid to a plurality of containers.

A still further desirable object of the present invention is to provide a liquid disbursing device for filling a plurality of containers with a liquid such as engine oil.

A still further desirable object of the present invention is to achieve the above desirable objects with an essentially simple structure lending itself to inexpensive mass production.

These and other desirable objects of the present invention will in part appear hereinafter and will in part become apparent after consideration of the specification with reference to the drawings and the claims.

SUMMARY OF THE INVENTION

Briefly stated, the broad purpose of the present invention is to provide a liquid disburser device for simultaneously equally filling a plurality of liquid containers from a common source of fluid. The liquid disburser device of the present invention includes a top member having an upper funnel chamber section for receiving liquid and a lower liquid discharge column leading downwardly from the chamber section. The discharge column has an inner diameter of sufficiently reduced size whereby liquid enters the discharge column from the upper funnel chamber in a filling equal amount. The discharge column includes a plurality of equally angularly spaced tubular members spaced in equal distance about the bottom portion of the discharge column. The tubular members extend downwardly and have respective end portions adapted to be inserted into the inlets of the liquid containers for conducting equal amounts of liquid from the liquid funnel chamber into respective liquid containers to be filled therefrom. In addition to a single discharge column, the present invention includes a first column section extending downwardly from the funnel chamber section and a second column section extending upwardly from the tubular members. The second column section has an enlarged inner diameter portion at the upper end section to receive a portion of the first column section and an inner annular shoulder section forming the end of the inner enlarged diameter portion to support the first column section. The liquid disburser device also includes a base support means.

Thus, there has been described broadly, the more important features of the present invention in order that the detailed description thereof that follows may be better understood. There are, of course, additional features of the present invention that will be described hereinafter and which will form the subject matter of the claims of the invention.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
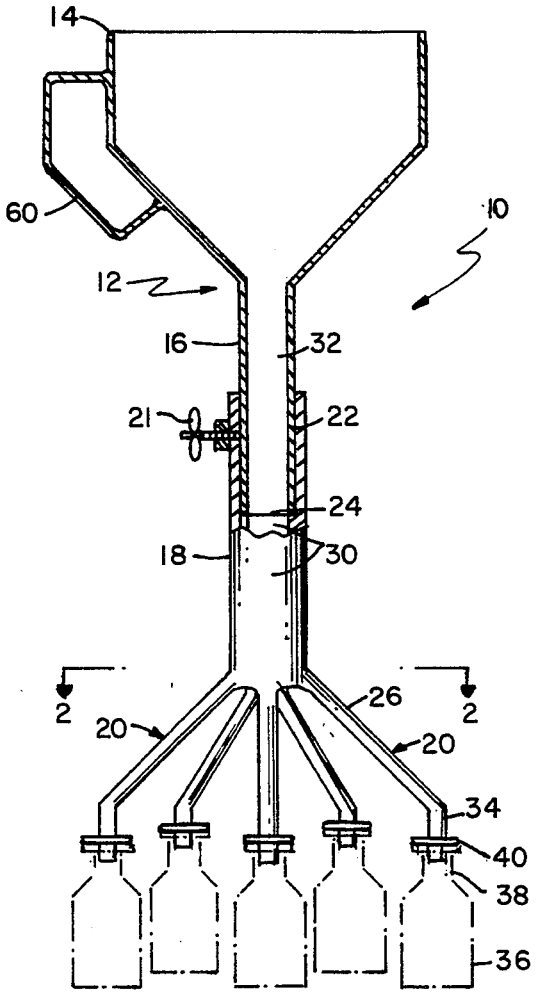
FIG. 1 is a side elevation view, partially in cross section of a liquid disbursing device in accordance with the present invention.
Figure 2:
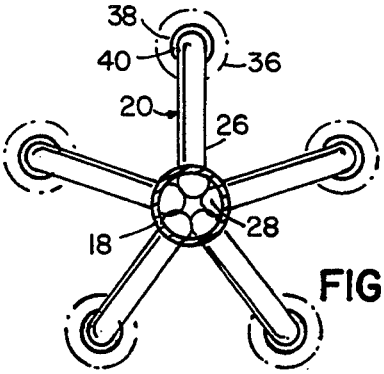
FIG. 2 is a cross-sectional view of the liquid disbursing device as viewed along the line 2—2 of FIG. 1.

Referring now to the drawings and more particularly to FIGS. 1 and 2, there is illustrated a new and improved liquid dispensing device, indicated generally by the reference numeral 10, for simultaneously and equally filling a plurality of containers. The liquid disbursing device 10 includes a top member 12 having an upper funnel chamber section 14, having a generally conventional shape, and a lower first liquid discharge column section 16 leading vertically downward from the chamber section 14. A second liquid discharge column section 18 extending vertically upwardly from the tubular members 20. The upper portion of the second column section 18 is provided with an enlarged inner diameter portion 22 which terminates in an inner annular shoulder member 24 which supports the first column section 16 when inserted into the second column section 18 as illustrated in FIG. 1. In a preferred embodiment, the lower column 18 is provided with a screw assembly clamping means 21 so that the upper column 16 can be adjusted up or down within the lower column 18 to vary the height. The tubular members 20 are equally angularly spaced in equal distance about the bottom portion of the lower liquid discharging column member 18. The tubular members 20 include an elongated section 26 which extends outwardly and angularly downwardly from the lower end of the second discharge column 18. The inner chamber sections 28 of the tubular members 20 contact the inner chamber section 30 of the second column 18 which connects with the chamber section 32 of the first column 16. In the preferred embodiment, the end sections 34 of the tubular members 20 are vertically structured to extend downwardly so that the vertical sections 34 can be easily inserted into the liquid container openings 38. Also in the preferred embodiment, the vertical sections 34 of the tubular members 20 are each provided with a horizontal outer rim member 40 to thereby support the tubular members 20 upon the top of the liquid container openings 38. In an alternate embodiment the first liquid discharge column section 16 may include a valve, such as valve 84, for controlling or preventing the flow of liquid down through the discharge column.

Figure 1A:
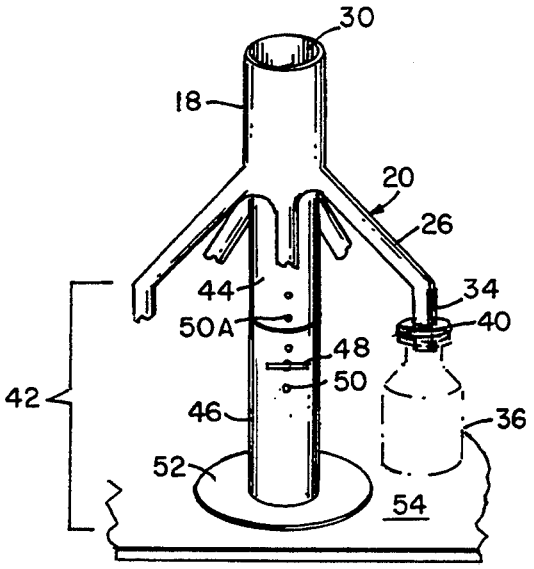
FIG. 1A is a fragmentary perspective view of an alternate embodiment of the liquid dispensing device of FIG. 1.
Figure 1B:
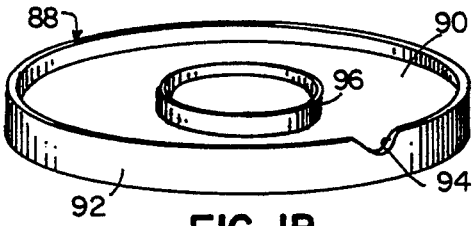
FIG. 1B is a perspective view of a catch pan tray device forming an alternate embodiment of the liquid disbursing device of the present invention illustrated in FIG. 1A.
Figure 3:
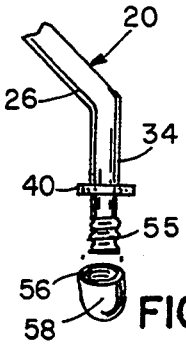
FIG. 3 is a fragmentary side perspective view of a tubular member with a closure cap.
Figure 3A:
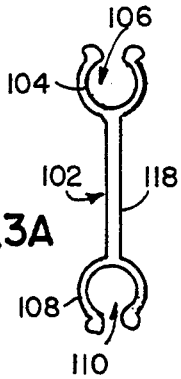
FIG. 3A is a top plan view of a strap attaching device for attaching a cap in accordance with the present invention.
Figure 3B:
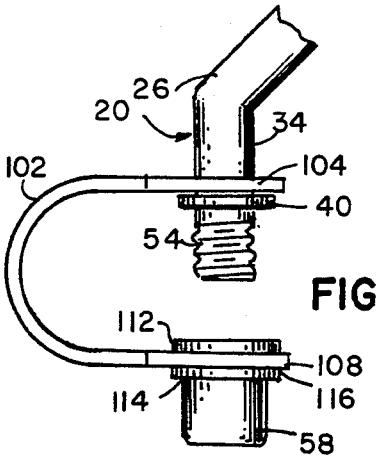
FIG. 3B is a side elevational view illustrating the cap strap attachment in accordance with the present invention.

Referring now more particularly to FIGS. 1A and 3, there are illustrated alternate embodiments of the liquid disburser device 10. In FIG. 1A, the bottom portion of the liquid discharge column 18 is provided with an adjustable support means 42 comprising an upper tubular member 44 and a lower tubular sleeve member 46 which slides over the upper tubular member 44 and is releasably in selected positions by the pin means 48 which is inserted into the adjacent openings 50 and 50A. The lower sleeve member 46 is provided with a base means 52 for supporting the liquid disburser device 10 on any selected support member 54 such as a floor or table, for example. In FIG. 3, the end sections 34 of the tubular members 20 are provided with external threads 55 to provide for the releasable attachment to the inner threads 56 of the cap means 58. In this manner, the tubular members 20 can be sealed after use or during disbursement if certain tubular members 20 are not being used. Referring now to FIGS. 3A and 3B, there is shown a strap attaching means 102 for attaching the cap means 58 to the end section 34 of the tubular member 20 to prevent loss of the cap 58. The strap attaching means 102 includes a first flexible circular clamp means 104 having a forward open section 106 for attaching to the end section 34 of the tubular member 20 above the rim member 40, and a second flexible circular clamp means 108 having a forward open section 110 for attaching to the cap means 58. The cap means 58 is provided with spaced rim members 112 and 114 so that the clamp means 108 can be inserted about the cap means 58 in the space 116 defined between the rim members 112 and 114. The strap attaching means 102 can, for example, be formed of a plastic material in which the elongated section 118 is flexible and bendable and the end sections 104 and 108 are sufficiently flexible to releasably attach to the tubular section 34 and the cap means 58. Also, in a preferred embodiment, the chamber section 14 is provided with a handle means 60 as illustrated in FIG. 1. Referring now more particularly to FIG. 1B, there is illustrated a catch pan tray device 88 which includes a circular base member 90, a circular wall member 92, a pour mouth section 94, and a center supporting ring member 96. The ring member 96 is adapted to receive the base support means 52 of FIG. 1A. In this manner, the liquid containers 36 are supported about the base member 90. In this embodiment, any liquid which accidentally overflows onto the catch pan tray device 88 can be poured through the mouth section 94 into a liquid container 36, for example.

Figure 1C:
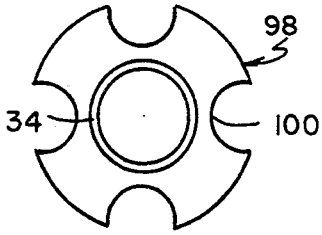
FIG. 1C is a top plan view of an alternate embodiment of the horizontal rim member.
Figure 4:
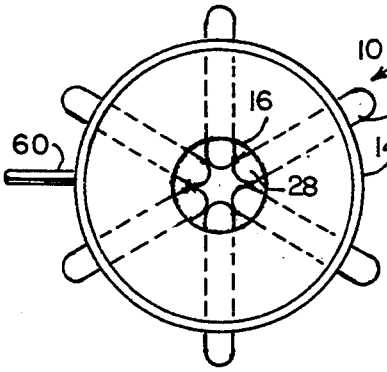
FIG. 4 is a top plan view of a alternate embodiment of a liquid disbursing device in accordance with the present invention.

Referring now to FIG. 1C, there is illustrated an alternate embodiment of a horizontal rim member 98 which is provided with a plurality of vents 100 whereby air in the containers 36 may flow out quickly and easier during the filling process. Referring now to FIG. 4, there is illustrated an alternate embodiment of the liquid disburser device 10 wherein there are six tubular members 20. Accordingly, it is to be understood that in accordance with the present invention the number of tubular members 20 can be varied depending upon the amount of liquid and the number of liquid containers to be equally filled.

Figure 5:
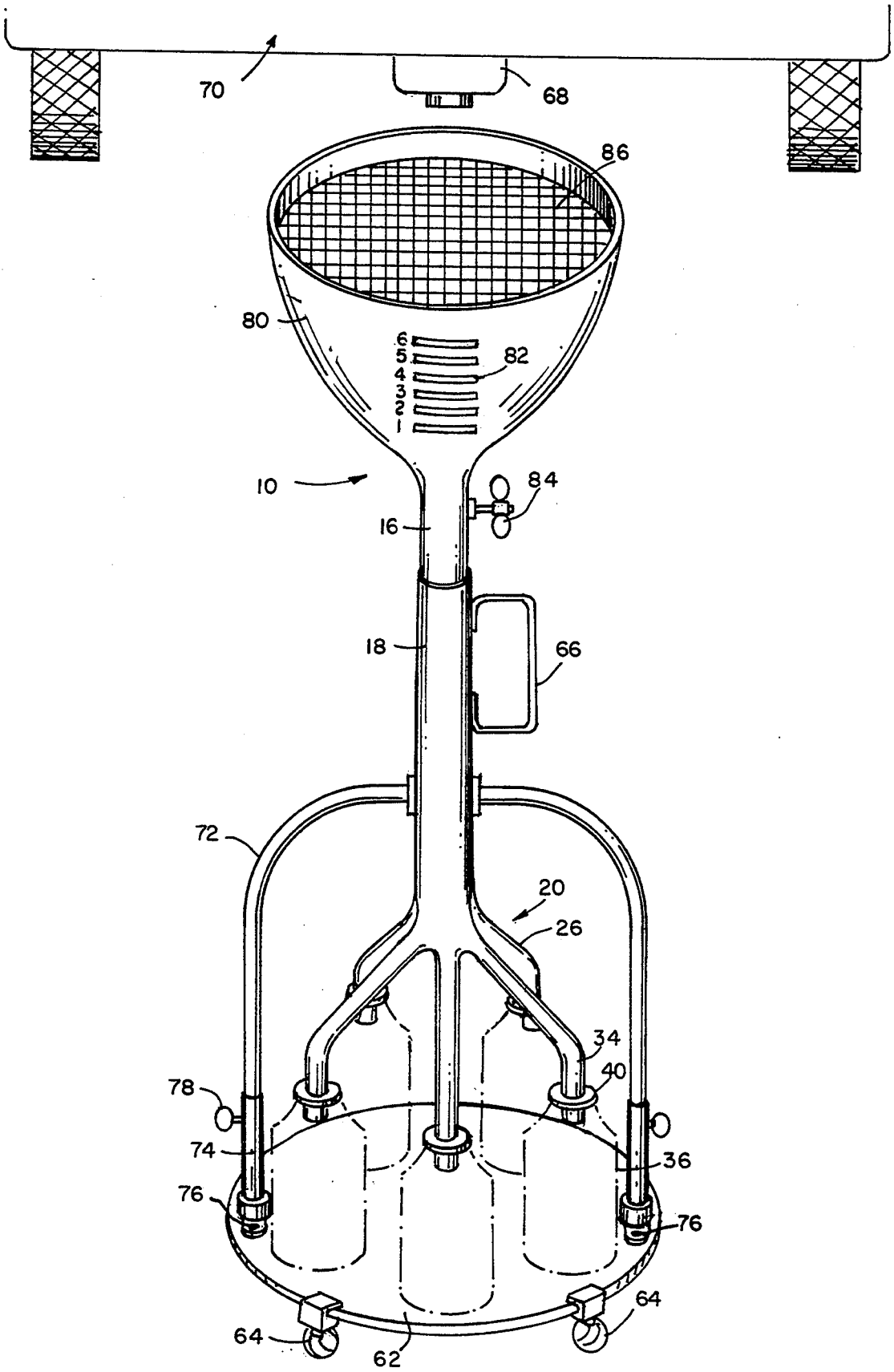
FIG. 5 is a side perspective view of an alternate embodiment of a liquid disbursing device illustrating an example of use.

Referring now more particularly to FIG. 5, there is illustrated an alternate embodiment of the liquid disburser device 10 in accordance with the present invention and one example of the use of the device. In this embodiment, the liquid disburser device 10 includes a base support member 62 mounted on wheels 64 so that the device 10 can be moved from place to place as desired. In this embodiment, the liquid disburser device 10 has been moved by handle 66 under the oil crank case 68 of the automobile 70 which is on a conventional lift not shown. The liquid disburser device 10 includes adjustable support members 72 which are attached by sealing, for example, to the outer surface of the liquid discharge column 18, and the adjustable screw section 74 which is attached to the base support member 62 by screws 76. The upper support member 72 slides within the screw support members 74 and is sealed in the selected height position by screw means 78. In this manner, the upper funnel chamber member 80 and the tubular members 20 can be varied up and down in height.

The liquid chamber member 80 can be formed to hold a selected volume of liquid. As illustrated, the chamber 80 includes viewing means 82 such as transparent plastic means through which the level of liquid can be viewed. Additionally, the funnel chamber 80 is provided with a fine screen means 86 to prevent undesirable objects from entering. In this embodiment, the upper discharge column 16 is shown having a valve means 84 for controlling or preventing the flow of liquid down through the discharge columns 16 and 18. When the valve 84 is closed, the volume from the valve 84 up to the plastic means 1 is a quart volume. Similarly the liquid volume from each plastic means to the one above such as 1 to 2, 2 to 3, 3 to 4, 4 to 5 and 5 to 6 each, for example, represent a quart volume.

With respect to this example of the manner of usage and operation of the liquid disburser device 10 of FIG. 5, the device 10 is rolled under the crank case 68 of the lifted automobile 70. The valve means 84 is closed and the crank case 68 opened so that the liquid oil drains into the chamber 80 and the volume or number of quarts of oil received is indicated. The valve means 84 is then opened allowing the liquid oil fluid to flow through the upper and lower liquid discharge columns 16 and 18 respectively and equally through the tubular members 20 thereby equally filling the liquid containers 36.

Figure 6:
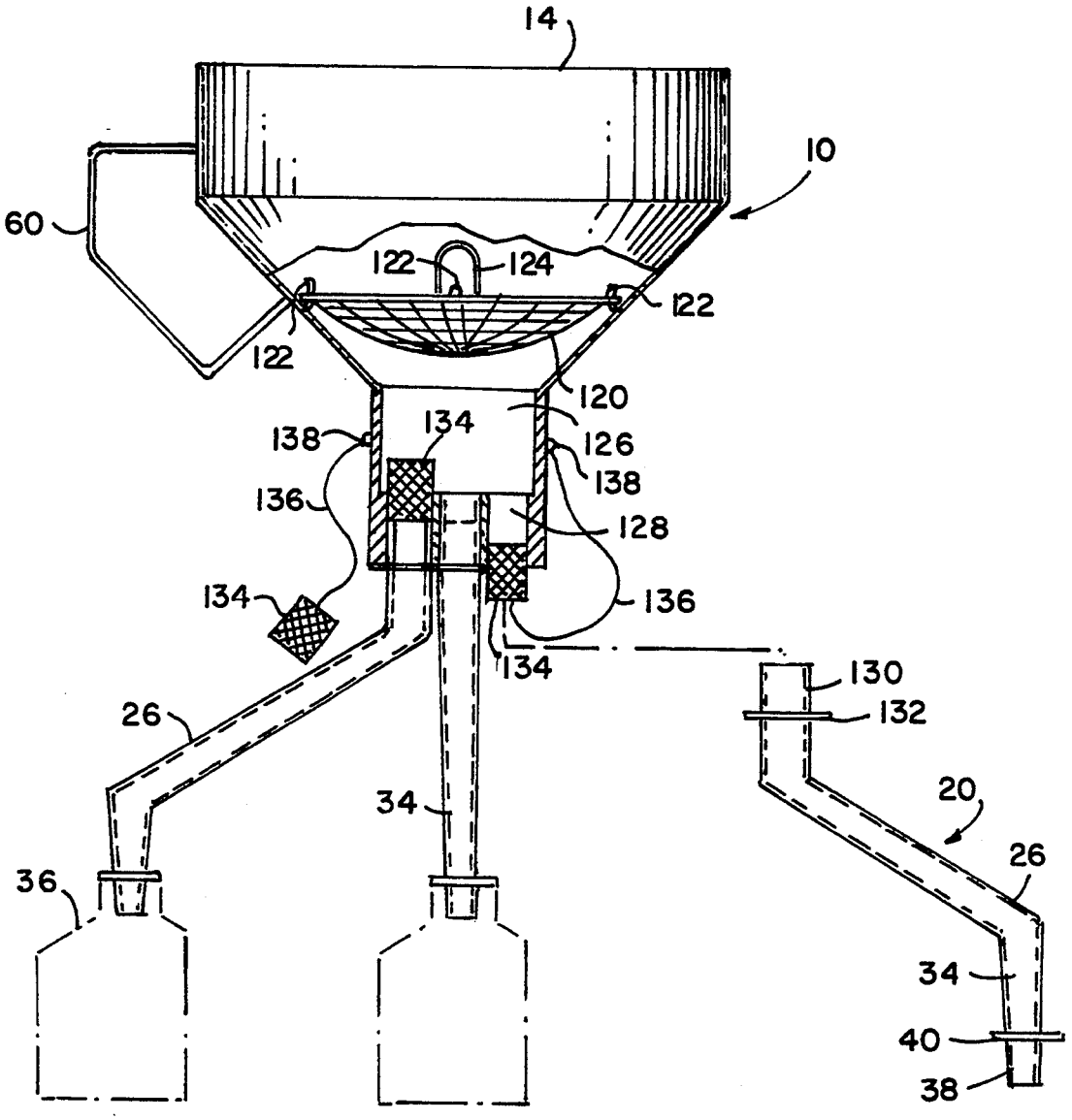
FIG. 6 is a fragmentary side elevational view, partially in cross-section, of an alternate embodiment of the liquid disbursing device in accordance with the present invention.

Referring now to FIG. 6, there is shown an alternate embodiment of the liquid disbursing device 10 in accordance with the present invention. The chamber section 14 is provided with a removable screen device 120 which is held in position by clamp means 122. The screen device 120 also includes a tab device 124 for inserting and removing the screen device 120 from the chamber section 14. The discharge column 126 is provided with lower inner chambers 128 to receive the tubular members 20. In this embodiment, the tubular members 20 are provided with an upper section 130 and a rim member 132 whereby each tubular member 20 is inserted into an inner chamber 128. The liquid disbursing device 10 includes inner chamber removable insert plug devices 134 which are inserted into the top portion of selected inner chambers 128 to thereby prevent liquid from flowing from the discharge column 126 into a tube member 20. As an alternative means for preventing the flow of liquid through selected inner chambers 128, a tubular member 20 is removed from the inner chamber 128 and the insert plug member 134 inserted into the bottom portion of the inner chamber 128. In the preferred embodiment, the plug device 134 is attached to the cord 136 which is attached to the eyelet device 138 on the outer surface of the discharge column 126.

Figure 7:
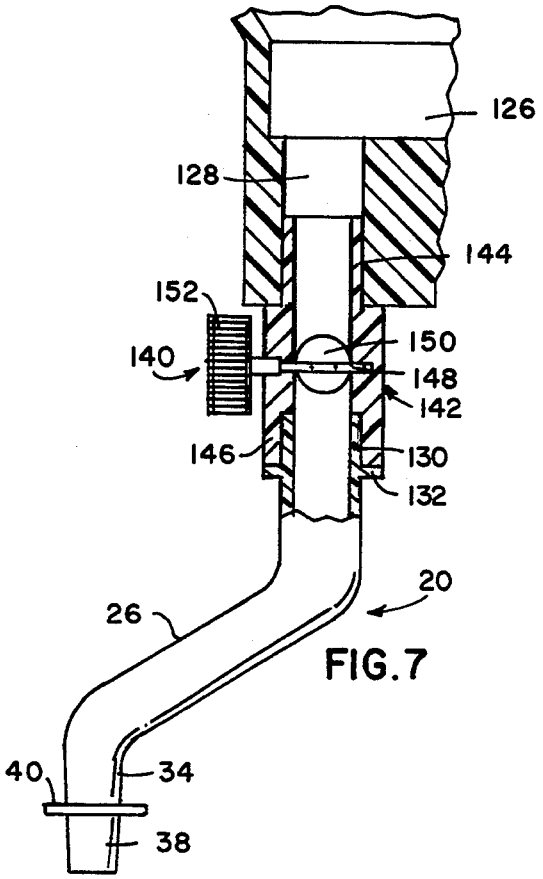
FIG. 7 is a fragmentary side elevational view illustrating an alternate embodiment of a liquid flow control device for the tubular members in accordance with the present invention.

Referring now to FIG. 7, there is illustrated an alternative liquid flow control means indicated generally by the numeral 140, for the liquid disbursing device shown in FIG. 6. The liquid control means 140 includes a valve means 142 having an upper channel section 144 with an outer diameter of sufficient size for insertion into the inner chamber 128 and a lower channel section 146 with an inner diameter of sufficient size to receive therein the upper section 130 of the tubular member 20 with the rim member 132 contacting the bottom end of the lower channel section 146. A valve shaft 148 is connected through the center of the valve means 142 and is rotatable. The valve means 48 includes a valve member 150 and a valve handle 152. Although the primary operation of the valve means 142 is to provide for permitting the flow of liquid or stopping the flow of liquid, the rate of flow of liquid can also be provided for a selected rate.

Figure 8A:
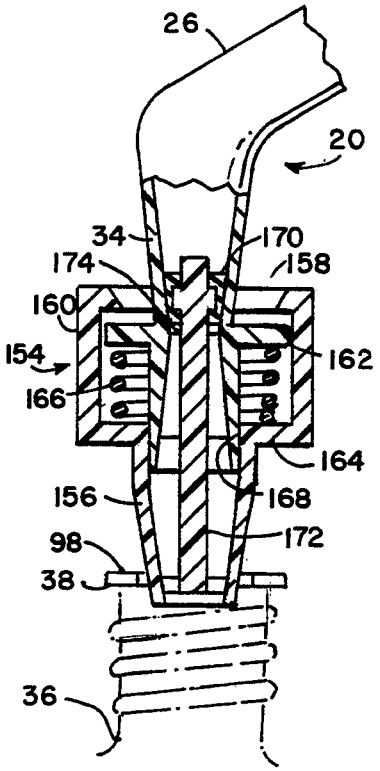
FIGS. 8A and 8B are fragmentary partially cross-sectional views of another embodiment of a liquid flow control device for the tubular members in accordance with the present invention.
Figure 8B:
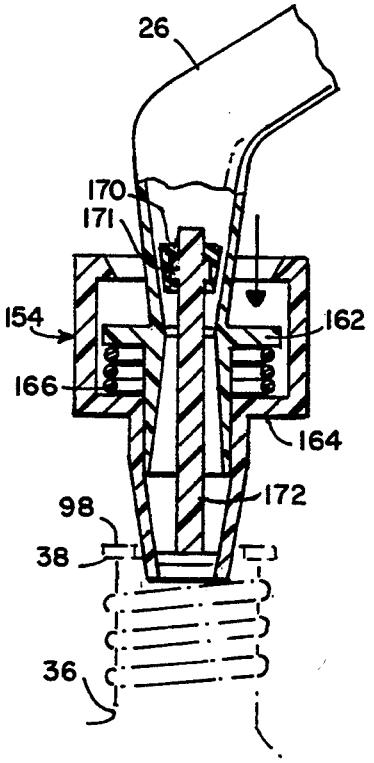

FIGS. 8A and 8B show another embodiment for controlling the liquid to be distributed from the tubular members 20. The spring valve housing means 154 includes a lower channel section 156 with a rim member 98 attached adjacent to the bottom of the lower channel section 156 which supports the tubular members 20 upon the top of the opening 38 of the liquid container 36. The end section 34 of the tubular member 20 is preferably tapered inwardly to a position within the opening 158 of the upper channel section 160 to the attachment of the rim member 162. The end section 34 of the tubular member 20 then preferably extends slightly outwardly to a point adjacent the horizontal bottom portion 164 of the upper channel section 160. Between the rim member 162 and horizontal bottom portion 164 of the upper channel section 160 is a compressible spring device 166 mounted about the outwardly extending end portion 168 of the tubular member 34 and between the rim member 162 and the horizontal bottom portion 164 of the upper channel section 160. Positioned within the end section 34 of the tubular member 20 is a valve stopper member 170 attached about the ring member 171 at the upper end of the stem member 172 and is closed against the tapered inner diameter of the end section 34 to the inner rim member 174. As shown in FIG. 8A the valve stopper member 170 prevents liquid to flow through the end section 34 of the tubular member 20 into the container 36. As shown in FIG. 8B, when the lower section 34 of the tubular member 20 is pushed downwardly as indicated by the arrow, the stopper member 170 is moved upward whereby the liquid within the tubular member 20 then flows downwardly into the container 36. In this manner the selected amount of liquid to be discharged through the tubular member(s) can be quickly and easily obtained.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A liquid disburser device for simultaneously equally filling a plurality of liquid containers from a source of liquid comprising:

a top member having an upper funnel chamber section for receiving liquid;

a first discharge column section extending downwardly from the upper funnel chamber section;

a second discharge column section extending upwardly from the tubular members, said second discharge column section having an enlarged inner diameter portion at the upper end section to receive a portion of the first discharge column section and an inner annular shoulder section forming the end of the inner enlarged diameter portion to support the first discharge column section;

said first discharge column having an inner diameter of sufficiently reduced size whereby liquid enters said first discharge column from said funnel chamber section in a filling equal amount;

said second discharge column having a plurality of equally angularly spaced tubular members spaced in equal distance about the bottom portion of said second discharge column;

said tubular members extending downwardly and having respective end portions adapted to be inserted into the inlet of a liquid container from conducting equal amounts of liquid from said funnel chamber section into respective containers to be filled therefrom; and the first discharge column having a valve means attached adjacent the upper funnel chamber, said valve means being responsive to permit or prevent the flow of liquid from the upper funnel chamber section.

2. The liquid disburser device according to claim 1 wherein the tubular members have a vertical end section and a horizontal rim member disposed about the outer surface of the vertical end section to support the tubular members on the top of the respective liquid containers.

3. The liquid disburser device according to claim 2 wherein the horizontal rim member includes a plurality of vents whereby air in a container to be filled will flow out easier during filling.

4. The liquid disburser device according to claim 1 including a base support means for supporting a liquid disburser device and vertically adjustable means attached to the discharge column and the base support means to adjust the liquid disburser device at a selected height above the base support means.

5. The liquid disburser device according to claim 4 wherein the base support means is mounted on a plurality of wheel means so that the liquid disburser device can be moved from place to place as desired.

6. The liquid disburser device according to claim 1 wherein the upper funnel chamber includes means for determining the volume of liquid contained therein.

7. The liquid disburser device according to claim 1 wherein the end portions of the tubular members include attachable cap devices and external threads to provide for releasable attachment of the cap devices.

8. The liquid disburser device according to claim 7 including a strap attaching means for attaching the cap devices to the end sections of the tubular members.

9. The liquid disburser device according to claim 1 wherein said upper funnel chamber section contains a screen device to prevent undesirable objects from entering the upper funnel chamber section.

10. A liquid disburser device for simultaneously equally filling a plurality of liquid containers from a common source of liquid comprising:

a top member having an upper funnel chamber section for receiving liquid and a lower liquid discharge column leading downwardly from said upper funnel chamber section;

said discharge column having an inner diameter of sufficiently reduced size whereby liquid enters said discharge column from said chamber in a filling equal amount;

a valve means for controlling or preventing the flow of liquid down through the discharge column attached to the discharge column adjacent the upper funnel chamber;

a plurality of equally angularly spaced tubular members spaced in equal distance about the bottom portion of said discharge column;

said tubular members extending downwardly and having respective vertical end portions adapted to be inserted into the inlet of a liquid container for conducting equal amounts of fluid from said upper fluid chamber section into respective containers to be filled therefrom;

a horizontal rim means to support the tubular members upon the top of the liquid container and disposed about the outer surface of the vertical end portions of the tubular members, said horizontal rim means containing a plurality of vent means;

a base support means for supporting a liquid disburser device; a vertical adjustable means attached to the discharge column and the base support means to adjust the liquid disburser device at a selected height above the base support means; and a liquid catch pan means, said liquid catch pan means having a center ring member to receive the base support means; and a circular base member for supporting the liquid containers whereby liquid which overflows the liquid containers is secured in the catch pan means.

* * * * *